US005732989A

United States Patent [19]

Stevenson et al.

[11] Patent Number: 5,732,989

[45] Date of Patent: Mar. 31, 1998

[54] LOCK AND TOOL THEREFOR

[75] Inventors: David L. Stevenson, Angola; Rodney Ridenour, Fremont; Robert E. Stone, Upland; Craig Hamilton, Waterloo, all of Ind.

[73] Assignee: Transgaurd Industries, Inc., Angola, Ind.

[21] Appl. No.: 662,673

[22] Filed: Jun. 14, 1996

[51] Int. Cl.[6] ..... E05B 39/02

[52] U.S. Cl. ..... 292/327; 292/318; 411/267; 411/433

[58] Field of Search ..... 292/327, 329, 292/328, 318, 319, 323, 324; 70/34; 411/517, 519, 267, 433, 352

[56] References Cited

U.S. PATENT DOCUMENTS

| | | | |
|---|---|---|---|
| 2,319,753 | 5/1943 | Smith et al. | 292/327 X |
| 4,015,456 | 4/1977 | Moberg . | |
| 4,280,726 | 7/1981 | McCoag . | |
| 4,483,164 | 11/1984 | Nielsen, Jr. et al. . | |
| 4,681,356 | 7/1987 | Brammall . | |
| 4,690,443 | 9/1987 | Brammall . | |
| 4,728,132 | 3/1988 | Brammall . | |
| 4,802,699 | 2/1989 | Smith | 292/327 |
| 4,802,700 | 2/1989 | Stevenson et al. . | |
| 4,929,135 | 5/1990 | Delarue et al. | 411/264 X |
| 5,160,180 | 11/1992 | Mlynarczyk | 411/433 X |
| 5,347,689 | 9/1994 | Georgopoulos et al. . | |
| 5,413,393 | 5/1995 | Georgopoulos et al. . | |
| 5,427,488 | 6/1995 | Fullerton et al. | 411/433 |
| 5,450,657 | 9/1995 | Georgopoulos et al. . | |
| 5,580,200 | 12/1996 | Fullerton | 411/433 X |

FOREIGN PATENT DOCUMENTS

| | | | |
|---|---|---|---|
| 72788 | 11/1947 | Norway | 411/433 |

OTHER PUBLICATIONS

E.J. Brooks Company, *Brooks Trans–Lok Seals*, 1 sheet, Jan. 1989.

E.J. Brooks Company, *Seals & Locking Devices*, catalog 6 sheets, Jan./Feb. 1995.

*Primary Examiner*—Rodney M. Lindsey
*Attorney, Agent, or Firm*—William Squire

[57] ABSTRACT

A lock body through bore receives a steel bolt with an array of annular grooves. A locking mechanism secured in the bore has an annular array of locking jaws normally biased engaged with an inserted bolt groove. A jaw spreader has a conical surface for spreading the jaws radially outwardly to disengage the bolt. A locking member normally is radially outwardly of the jaws to preclude such spreading. A spring with a high spring constant, e.g., 300 pound load, axially biases the locking member in the jaw locking position. The spreader and locking member define a locking jaw conical path for radially outwardly releasing the jaws during bolt insertion and for locking the jaws in the opposite bolt withdrawal direction. A manually operated tool with a rotatable cylinder which engages the spreader and including a pair of lock gripping tines provides a high force to the spreader to axial displace it against the locking member spring to release the bolt locking jaws while simultaneously radially outwardly releasing the jaws from the bolt.

20 Claims, 6 Drawing Sheets

LOCK AND TOOL THEREFOR

This invention relates to locks in which a grooved bolt is inserted.

Seals and locks are employed to protect the contents of locked rail cars, trucks, shipping containers and so on. Seals are devices that typically are destroyed when opened and are typically employed to show tampering with a locked compartment. Seals generally are easily destroyed to provide tamper evidence whereas locks are significantly more robust and resistant to destructive opening. Often, seals are used to "seal" a lock so that in order for a lock to be opened the seal first has to be broken.

Locks fall into a wide variety of configurations most widely used with keys which make the locks reusable. The keys typically are unique to a given lock and, therefore, a key needs to be provided for each lock. Other locking devices are hybrids of locks and seals. These locking devices employ a robust lock and a steel bolt which is permanently secured to the lock. To open the lock requires the bolt to be cut or otherwise destructively removed from the lock. Because the bolt shank is secured permanently in the lock, the destruction of the bolt destroys the lock. Such are one time use locks. Once destroyed they provide visual evidence of tampering.

For example, reference is made to U.S. Pat. Nos. 4,690,443, 4,802,700, 4,280,726 and 4,681,356 for locks, sometimes referred to as seals, of the one time use configuration. Other similar locks are available from the E. J. Brooks Company known as Trans-Lok Seals. Bolt cutters are employed to open these latter locks.

The one time use locks are generally used to lock the doors of cargo containers, rail cars and shipping containers and, therefore, need a robust design. However, opening of the one time locks or seals is costly. As a result newer seals have evolved for the transportation cargo use employing reusable locks with one time use cables or bolts. In these devices the cables or bolts are destroyed to open the locks but the locking mechanism portion of the lock is reusable comparison to the one time use of the locks described above. Such reusable seals are disclosed in commonly owned U.S. Pat. Nos. 5,347,689 and 5,413,393.

The problem with one time use locks is the need to replace such locks with different locks once used. Similarly, the reusable seals still need additional bolts or cables for additional uses once the lock or seal is opened. It is cumbersome and costly to provide additional locks and/or cables or locking bolts for subsequent uses. Key type locks also are cumbersome to deal with in that they require different keys for each different lock.

In some locks used to secure utility meters, plunger type locks are used as disclosed in U.S. Pat. Nos. 4,483,164 and 4,015,456. The '164 patent also discloses a so called key for use with a plunger lock. A plunger lock is not as robust as steel shank bolt locks described above for use in the transportation industry and is especially adapted for utility meter locking. These locks use expandable balls in the plunger for locking the plunger in a meter locking socket. A normally not removable insert is placed within a socket in the plunger to prevent the balls from contracting, locking the plunger. A tool referred to as a key is inserted into the insert to remove the insert and release the balls.

The present inventors recognize a need for a bolt lock in which the bolt and the lock are both reusable. The present inventors also recognize a need for a tool operated lock for use with a bolt to lock cargos without the costly and cumbersome need for additional locks and/or bolts and/or keys for each lock. The present inventors also recognize a need for a tool operated bolt lock that is easily opened with a standardized tool for all such locks but is extremely difficult to open manually without the tool and is substantially tamper resistant to resist picking.

A reusable lock for locking a reusable bolt having a shank with at least one locking recess according to the present invention comprises a body having a cavity with an opening defining a bolt receiving axis for axially receiving the bolt and the at least one recess within the cavity. At least one resiliently movable jaw is in the cavity. Displaceable jaw locking means are secured in the body cavity for 1 a) permitting the at least one movable jaw to transversely displace outwardly relative to the axis in response to and for permitting bolt insertion into the cavity in a bolt insertion direction, b) providing radially inward locking engagement of the at least one movable jaw with the bolt recess upon transverse alignment thereof and c) precluding the at least one movable jaw from outwardly disengaging the recess in response to bolt withdrawal opposite the bolt insertion direction in a locking state and 2) to disengage the at least one movable jaw from the recess in response to selective axial displacement of the locking means in a first direction to a release state.

In one embodiment, the first direction is opposite the insertion direction, the locking means include first bias means for resiliently biasing the at least one movable jaw in the locking engagement in a direction transverse the axis and second bias means for biasing the locking means in the insertion direction to the locking state.

In a further embodiment, the first bias means includes means for providing a first resilient radially inwardly directed locking bias value toward the axis and the second bias means includes means for providing a second resilient bias value on the locking means substantially greater than the first bias value so as to preclude manual unlocking of the locking means to the release state without a tool.

In a further embodiment, the second value is sufficiently high so as to require leveraged displacement of the locking means in the first direction to place the locking means in the release state.

In a still further embodiment, the second value is approximately several hundred pounds.

A tool for providing leveraged displacement to release the locking means comprises means for engaging the body and the locking means arranged to displace the locking means in the first direction relative to the body and to disengage the at least one movable jaw from the recess with a relatively high force value relative to an unassisted manual force value to provide leveraged manual displacement of the locking means and handle means for manually displacing the means for engaging.

A tool for placing the lock in the release state according to a further embodiment comprises a first handle. A second handle is pivotally secured to the first handle for displacement toward and away from the first handle. A first member is secured to the first handle for engaging the jaw locking means.

A clamp member is pivotally secured to the second handle for releaseably engaging and gripping the body of the lock and guide means are secured to the first handle for guiding the clamp member relative to the first member, the handles being arranged to cause the clamp member to displace relative to the first member in response to the handles being pivoted relative to each other to provide force magnification between the clamp member and the first member for placement of the jaw lock means in the release state.

Figure 1:
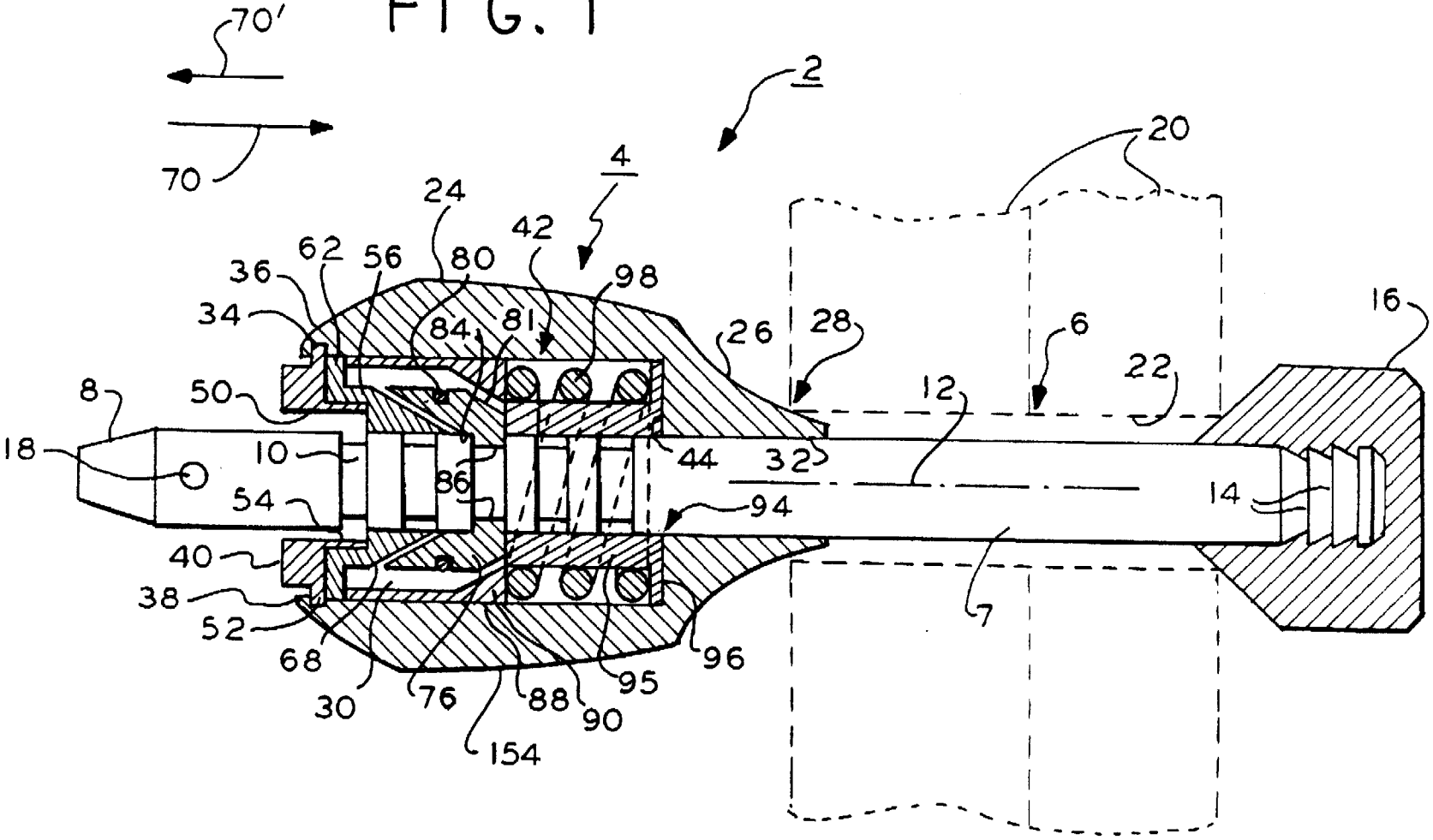
FIG. 1 is a side elevation sectional view of a locking device in a locked state according to one embodiment of the present invention.
Figure 2:
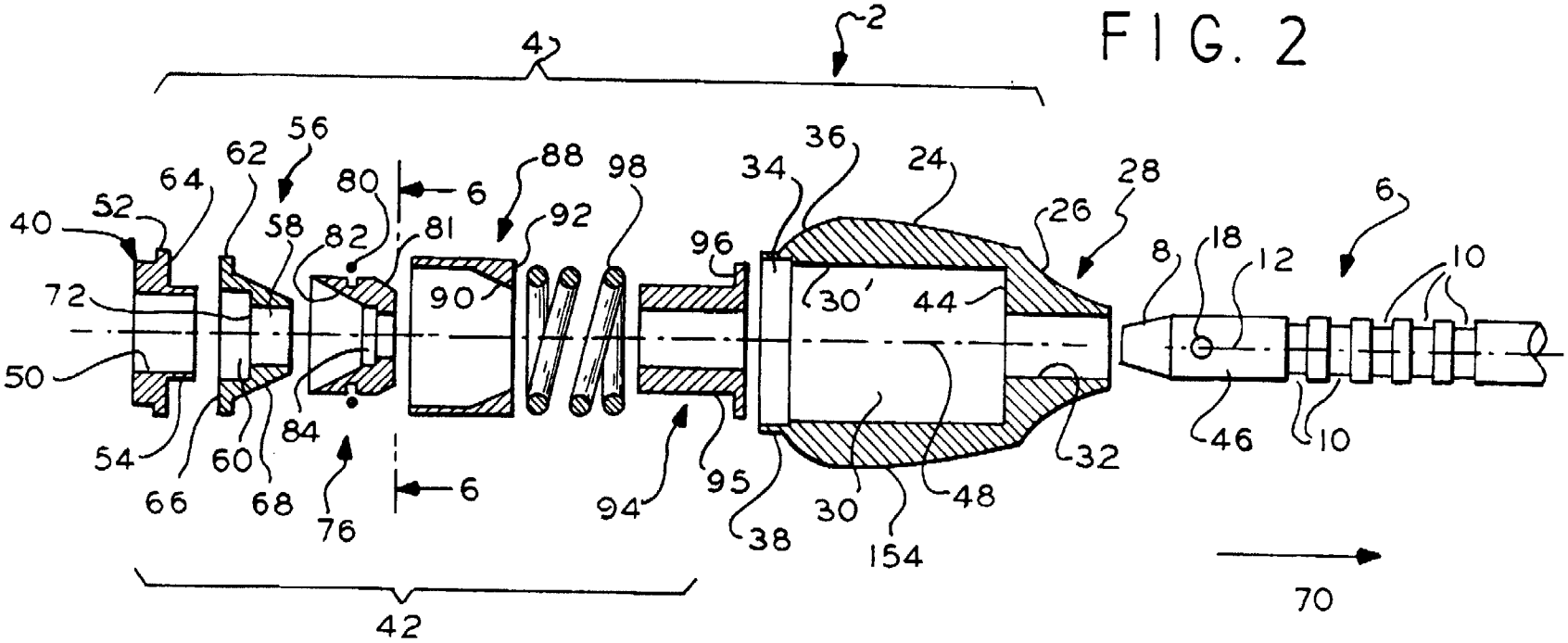
FIG. 2 is a side elevation sectional exploded view of the device of FIG. 1 with the bolt in position prior placement in the locked state.

In FIGS. 1 and 2, locking device 2 comprises a lock 4 and a mating bolt 6. The bolt 6 has a preferably steel circular cylindrical shank 7 with a tapered tip 8. The bolt 6 has an array of like preferably equally spaced annular preferably quadrilateral grooves 10, each having a cylindrical base wall and opposing parallel planar side walls normal to the bolt longitudinal axis 12. The rear end of the bolt 6 shank 7 has serrations 14. An enlarged metal head 16 is swaged or otherwise permanently fastened to the serrated end of the bolt 6 shank. A seal receiving aperture 18 is at the tip end of the shank 7. The head 16 and lock 4, both being larger than the hasp apertures 22, lock the hasps 20 (shown in phantom) therebetween to the shank 7.

Lock 4 includes a lock body 24 which preferably is case hardened steel as is the bolt. The body 24 has an external tapered narrowing portion 26 at proximal end 28 which may fit within the aperture 22 to preclude unauthorized insertion of a tampering tool between body 24 and the hasp in order to tamper and open the lock. The bolt head 16 is similarly tapered for the same purpose.

Figure 3:
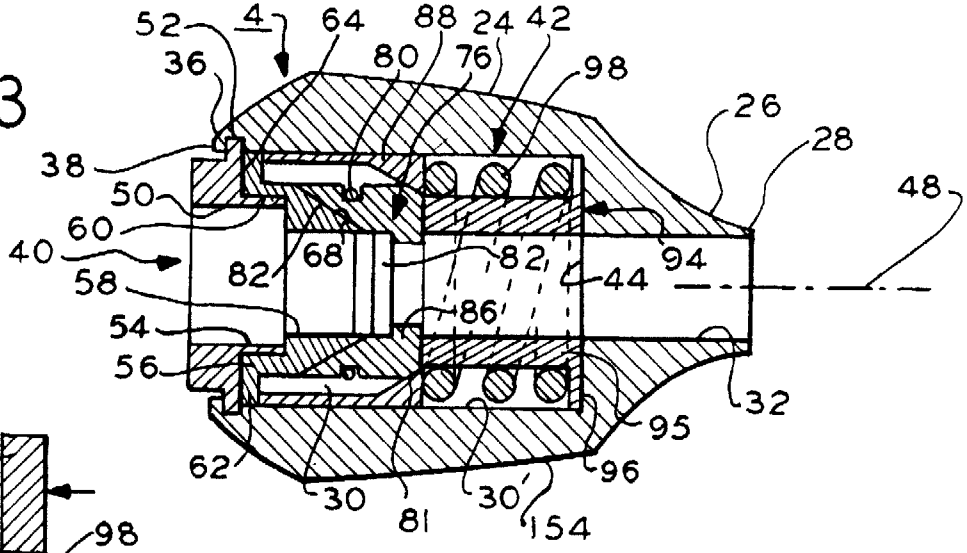
FIG. 3 is a side elevation sectional view of the lock of the device of FIG. 1 without the bolt.

The body 4, FIGS. 1, 2 and 3, has a circular cylindrical cavity 30 in communication with bore 32 at the proximal end 28 and bore 34 at the distal end 36. Cavity 30 receives locking mechanism 42. The distal edge 38 is swaged over as shown in FIG. 1 to form bore 34 into an annular groove for receiving locking mechanism retainer crimp ring 40 flange 52. The ring 40, which is steel, is locked to the body bore 34 by the swaged over edge 38 at the body 24 distal end.

The locking mechanism 42 is locked to the cavity 30 at the proximal end 28 by shoulder 44 formed by the reduced diameter bore 32. Bore 32 closely receives the bolt shank 7 on cavity 30 longitudinal axis 48 so that bolt axis 12 and cavity axis 48 are substantially coaxial. The crimp ring 40 has a cylindrical bore 50 which is larger than the shank 7 diameter. Ring 40 has a tubular extension 54 that extends into the cavity 30 toward the body proximal end 28.

A jaw spreader 56, FIG. 2, preferably steel, has stepped bores 58 and 60. Bore 60 receives the tubular crimp ring extension 54, FIG. 1. Bore 58 closely receives the bolt shank 7 and cooperates to align the bolt on the cavity 30 axis 48 and with the bore 32. The spreader 56 has a radially outwardly extending flange 62. Flange 62 outer edge abuts the inner wall 30' of cavity 30. In the quiescent state, whether in the locked condition of FIG. 1 or with no bolt assembled as shown in FIG. 3, flange 62 distal side 66 abuts the next adjacent surface 64 of the crimp ring 40.

The spreader 56 has a conical external surface 68. Surface 68 widens in direction 70 toward the distal end 36. Spreader 56 can displace in the cavity 30 in axial direction 70. A shoulder 72 is formed between bores 58 and 60 to effect such displacement by a tool 100 to be described below.

Figure 6:
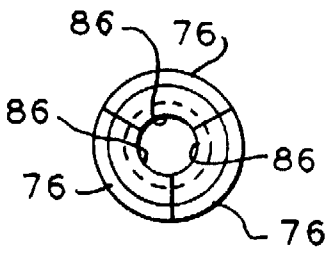
FIG. 6 is a front elevation view of the jaws of FIG. 2 taken along lines 6—6.
Figure 7:
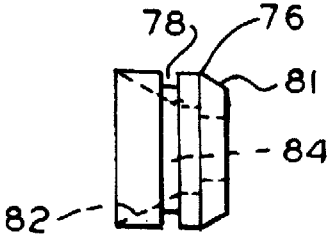
FIG. 7 is a side elevation view of the jaws of FIG. 5 similar to the view of FIG. 2.
Figure 5:
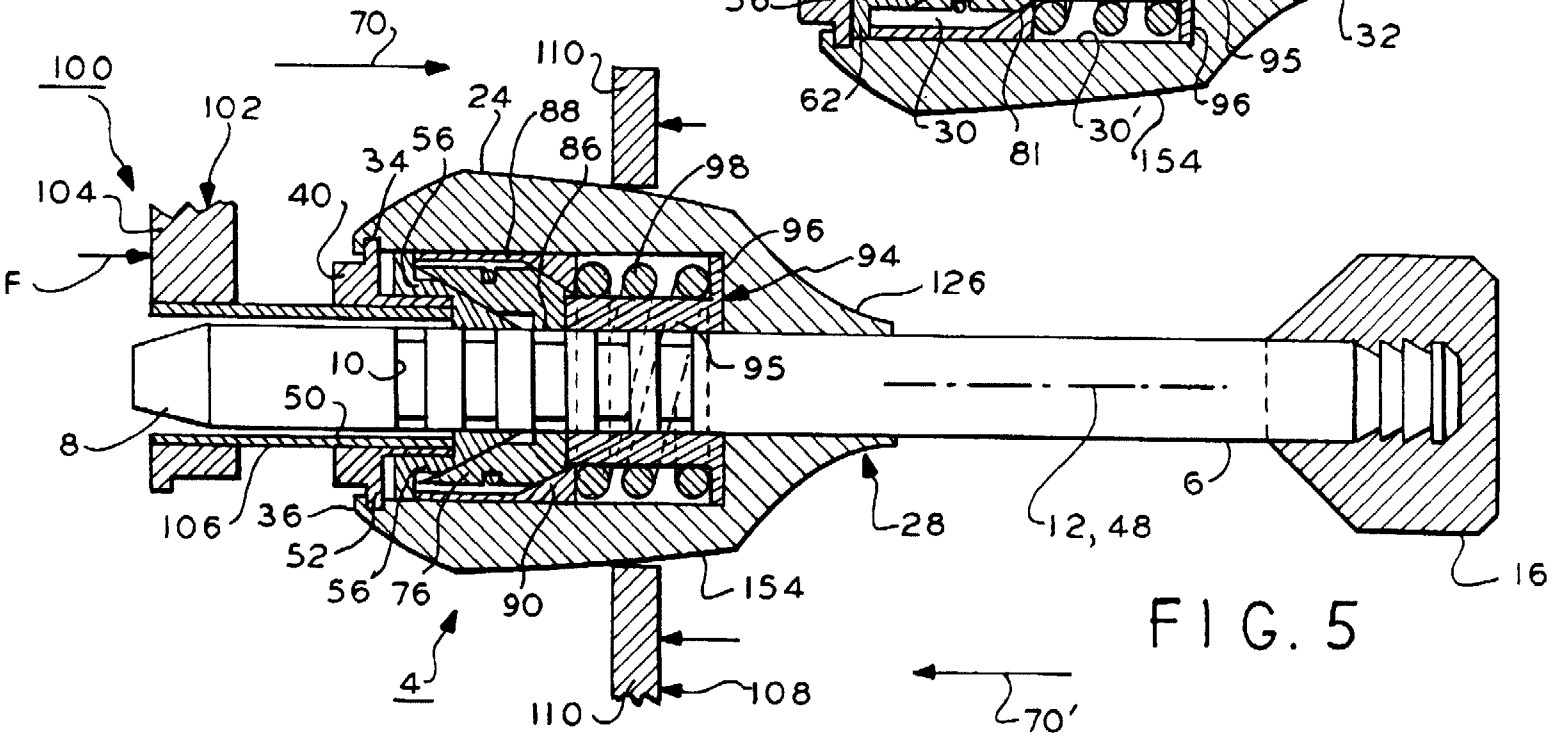
FIG. 5 is a side elevation sectional view similar to that of FIG. 1 with the lock in the release state with the locking jaws disengaged from the bolt.

In FIGS. 2, 5 and 6, locking jaws 76 are preferably steel and comprise three like radially extending collet-like segments. Jaws 76 together form a generally cylindrical locking member in radially expandable collet form and abut in the locked state as shown in FIG. 1 or in the quiescent state of FIGS. 3 and 5. An annular groove 78 is in the outer cylindrical surface of the jaws 76 for receiving a spring 80, for example, a metal or other material spring ring, but preferably metal. The jaws 76 have a conical outer surface 81 at their proximal end.

The jaws 76 have a conical bore 82. Bore 82 and surface 81 are preferably parallel. The conical bore 82 terminates radially inwardly in a circular cylindrical bore 84. Depending radially inwardly of each jaw 76 in the bore 82 is a locking projection 86. Projection 86 extends for the full extent of each jaw 76 so as together form a continuous circular depending bolt locking rib. The bolt locking projections 86 engage a selected bolt 6 locking groove 10. The conical bore 82 of the jaws 76 faces and engages the conical surface 68 of the spreader 56. The jaws 76 can slide radially outwardly and axially along surface 68, FIG. 1, in a conical path (arrows 70", FIG. 4) toward the distal end 38. The spring 80, which is relatively weak, has sufficient bias to normally resiliently keep the jaws 76 in the radial inward position in a quiescent or locking state of respective FIGS. 3 and 1.

The locking mechanism 42 further includes a jaw locking member 88, FIG. 2. The member 88 comprises a preferably steel relatively thin wall tubular circular cylinder with a radially inwardly depending conical portion 90 at the proximal end. The conical portion 90 narrows in diameter in a direction toward the proximal end of the lock. The inclined surface of the portion 90 forms a conical bore in the member 88 which faces and engages the external conical surface 81 of the jaws 76. Preferably, the conical surfaces of the spreading member 56, jaws 76 and locking member 88 are at 45° to axis 48. The locking member 88 conical interior surface 90 is radially aligned with the jaws 76 to preclude the jaws 76 from expanding radially outwardly. This locks the jaw projections 86 in the locking state of FIGS. 1 and 3. The locking member 88 proximal end face surface 92, FIG. 2, is planar and is ring-like.

A spring support member 94 has a circular cylindrical body 95 and a radially outwardly extending flange 96 at its proximal end. Flange 96 abuts the inner wall 30' of the cavity 30 and the shoulder 44. The bore diameter of the support member 94 is substantially the same as the bore 32 for closely receiving the bolt 6 on axis 48 in a bolt insertion direction 70' opposite direction 70. The member 94 cylindrical body 95 has an external diameter dimensioned so that the locking member 88 can be displaced in the space between the support member 94 body 95 and the cavity 30 inner wall surface 30' In this way the locking member can be selectively displaced toward the proximal end, direction 70, between the support member 94 and the lock body 24.

A coiled compression spring 98 is in the compartment formed by the support member body 95 and the lock body surface 30'. This is a steel spring and has an extremely high spring constant. For example, it is preferred that the spring 98 displace in response to an axial load of at least of about 300 pounds. The spring 98 is between and abuts the ring surface of the locking member 88 and the flange 96 of the spring support member 94, FIG. 3.

The spring 98 has a relatively high spring constant so that the locking member 88 cannot be displaced merely by hand without a tool. Also, not any tool will displace the locking member. Because of the relatively high spring load, a highly leveraged tool must be provided. Such a tool also is preferably manually operated, but is leveraged so that manual manipulation of the tool can displace the locking member selectively. The displacement of the locking member is necessary to radially unlock the jaws 76 to the release state of FIG. 5 as will be explained more fully below.

Figure 4:
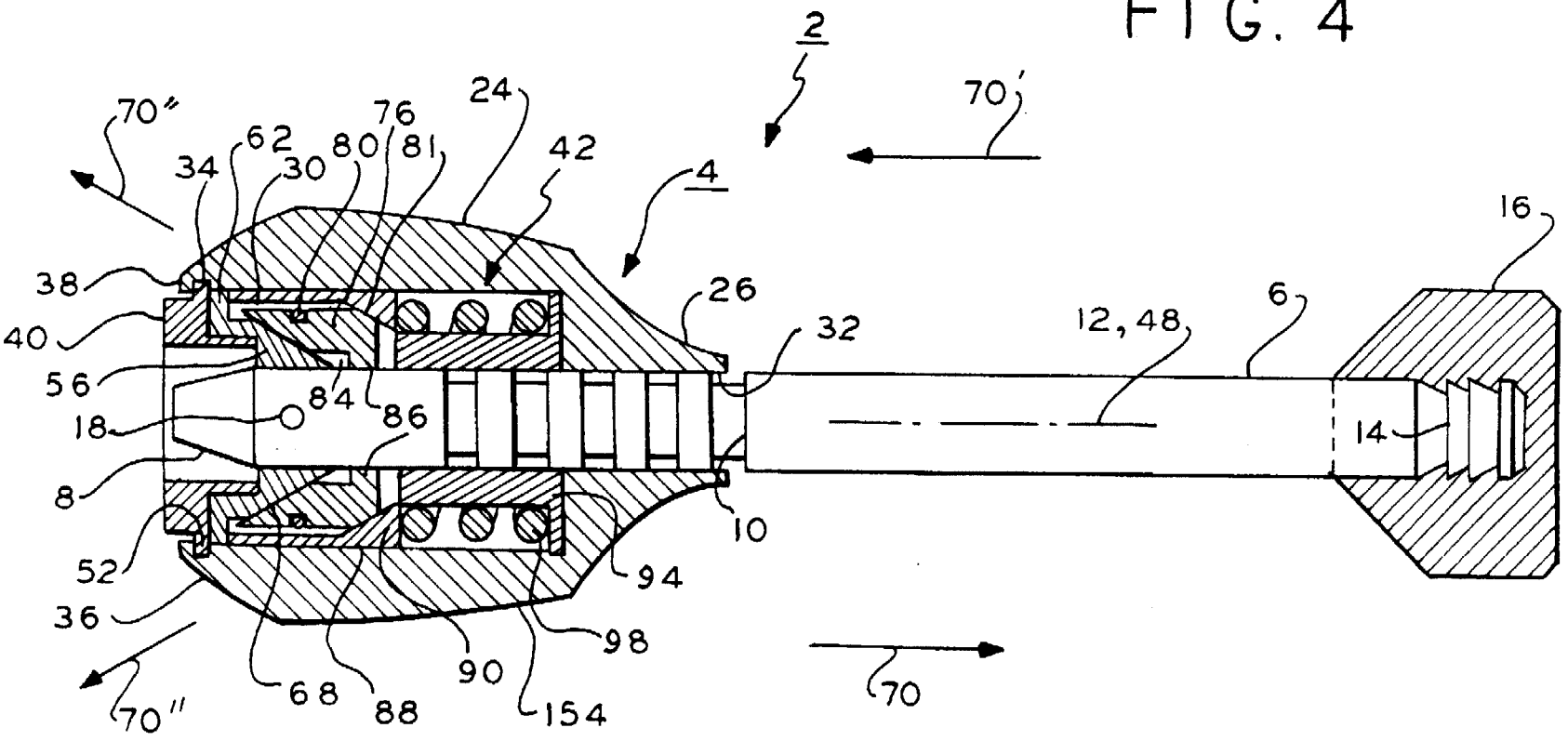
FIG. 4 is a side elevation sectional view similar to FIG. 1 showing the bolt during insertion into the lock.

In operation of the locking device 2, the bolt 6 is inserted into the cavity 30 of the lock body 24 in an insertion direction 70' opposite direction 70, FIG. 4. The bolt is passed through the hasp 20 (FIG. 1) so that the head 16 and lock body 24 lock the hasp therebetween. During insertion, the bolt tapered tip 8 engages the locking projections 86 of jaws 76. Manual insertion of the bolt in direction 70' causes the weakly spring loaded jaws 76 to slide in a conical path of arrows 70" defined by the conical facing surfaces of the spreader 56 and the conical portion of the locking member 88.

The jaws 76 are held by spring 80 in their quiescent position, FIG. 3. This spring offers little resistance to manual spreading forces created in response to the insertion of the bolt by hand. The spring 80 only needs enough force to keep the jaws radially inward in the quiescent state. The jaws 76 thus are easily manually spread apart as they are displaced both axially in direction 70' and radially outwardly in the direction of arrows 70" merely by insertion of the bolt by hand.

As soon as a bolt groove 10 aligns with the projections 86, the projections immediately snap into the groove in a locking state, FIG. 1. Further displacement of the bolt in the insertion direction 70' will force the projections out of that groove 10 to the position of FIG. 4 in the region between next adjacent grooves 10. The projections 86 will then snap into the next groove 10 and so on providing an adjustable bolt length in the locked state, FIG. 1.

In FIG. 5, the jaws are shown in the release state disengaged from any of the bolt 6 grooves 10. The jaws need to be expanded radially out of the lock state in a groove 10 to be released. This requires that the locking member 88 conical portion 90 be displaced, FIG. 5, toward the proximal end, direction 70. As shown in FIG. 5, the locking member is so displaced and is partially in the region between body 95 and cavity 30 surface 30'. To place the locking member in this position requires that the spring 98 be compressed somewhat as shown.

To compress the spring 98 and displace the locking member to the release state requires tool 100. Tool 100, FIGS. 5, 8 and 9, has a locking mechanism engaging assembly 102 which includes a support 104 and a cylinder 106. The cylinder 106 is hollow for receiving the bolt 6 therethrough and is closely received in the bore 50 of the retaining crimp ring 40. The tip of the cylinder 106 abuts the shoulder 72 of the spreader 56 in the axial direction 70.

The tool 100 also includes a lock body 24 gripping member 108 which preferably comprises a bifurcated set of body 24 gripping tines 110. The lock body 24 is tapered on its external surface so that the tines 110, FIG. 5, will engage and abut the body 24 in direction 70'. Tool 100 is universal in that it is used with all locking devices having bodies of the same dimensions as the body 24.

To release the jaws 76 to the state of FIG. 5, the cylinder 106 is forced at high force to overcome the spring load of spring 98 in a direction 70 toward tines 110 which are relatively stationary. As the cylinder 106 displaces in direction 70, the spreader 56 is axially displaced, direction 70. The spreader 56 flange 62 engages the distal end edge of the locking member body 88 and displaces the locking member 88 also in direction 70. The locking member 88 is displaced until the jaws 76 are outwardly radially released as shown in FIG. 5.

At the same time the spreader 56 is displacing in direction 70 it also engages the jaws 76 at the inner conical surfaces of their bore 82. Axial displacement of the spreader 56 also simultaneously radially outwardly cams the jaws 76 as the locking member 88 locking conical portion 90 is displaced out of the path of the radially displaced jaws. The spreader 56 is continuously displaced to the right in FIG. 5, direction 70, compressing spring 98 until the bolt 6 is freely displacable in direction 70 for withdrawal from the lock 4.

Thus both the bolt 6 and the lock 4 are reusable. No special matching key is required to open the lock and yet, because of its robust hardened casing and steel bolt and the high spring constant of spring 98, is difficult to open by tampering. Attempts at picking are believed fruitless because of the relatively high spring constant of spring 98.

Figure 8:
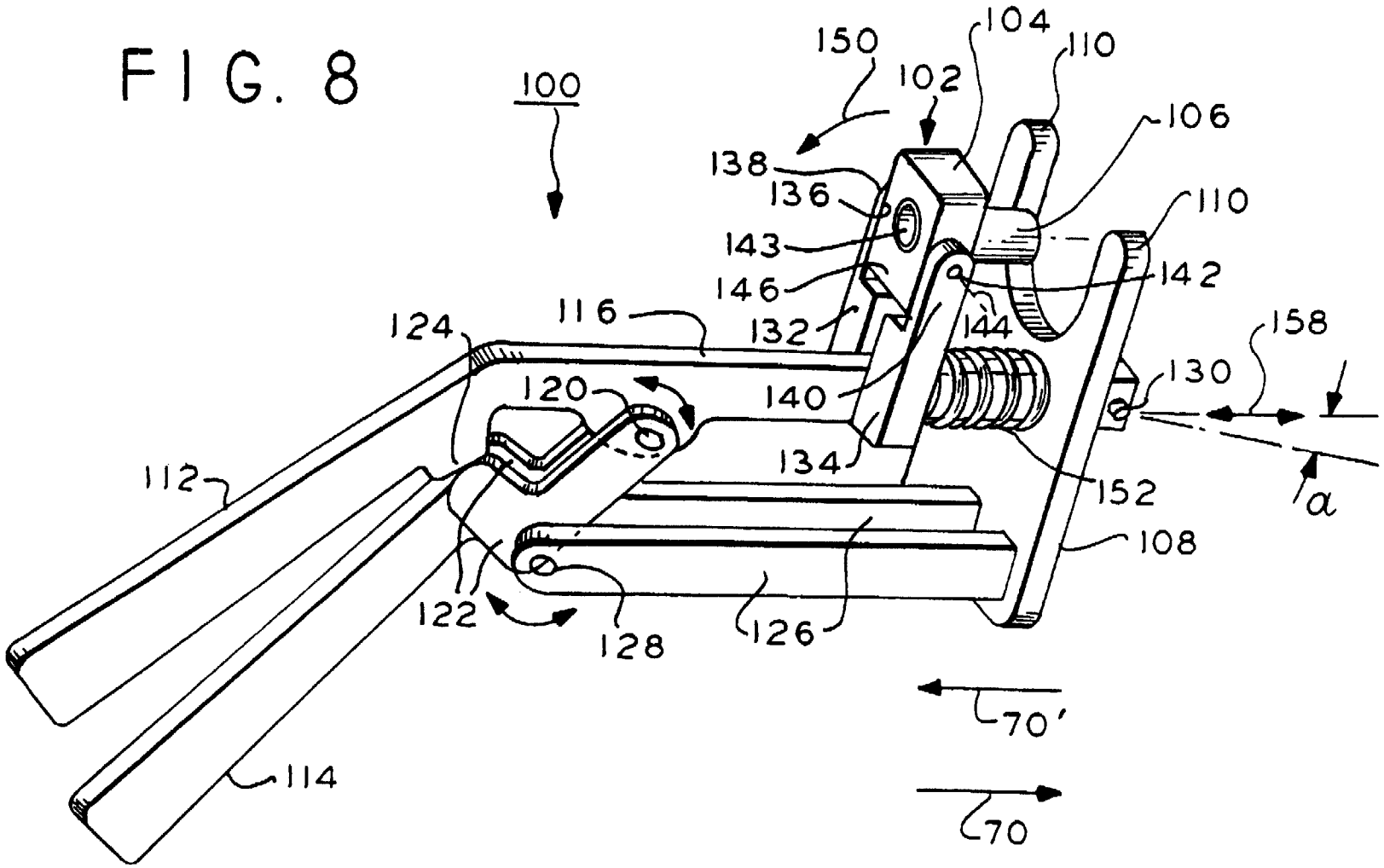
FIG. 8 is an isometric view of a tool according to the present invention for placing the locking device of FIG. 5 in the release state.
Figure 9:
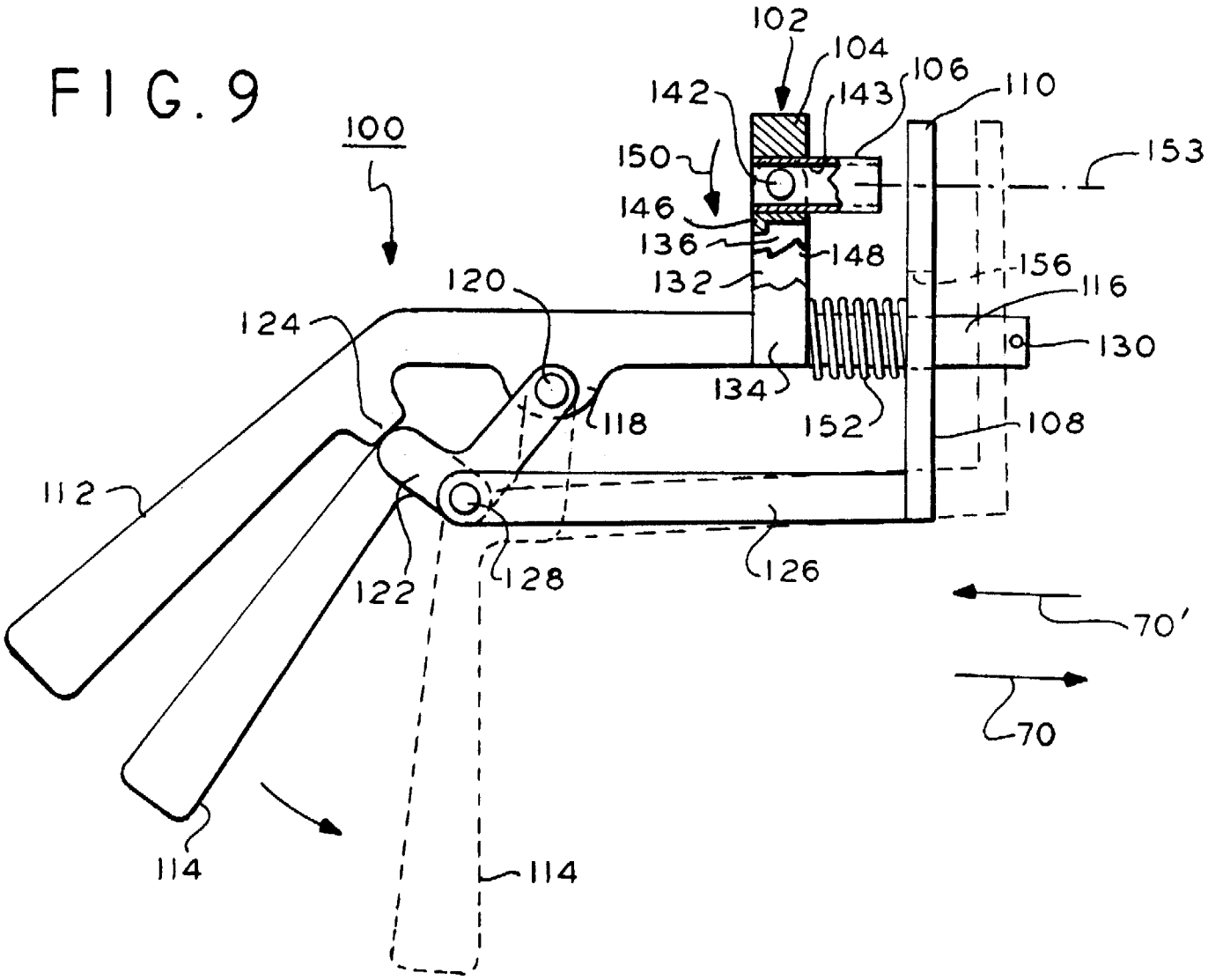
FIG. 9 is a side elevation view of the tool of FIG. 8.

In FIGS. 8 and 9, the tool 100 is shown in more detail and includes a pair of handles 112 and 114. Handle 112 includes a gripping member 108 guide 116 which is rectangular in transverse section. The handle 112 is one piece with the guide 116 and includes a boss 118. The boss 118 has a pivot pin 120 to which handle 114 is pivotally secured. The handle 114 has a pair of L-shaped members 122 which straddle the guide 116. The handle 112 has a stop 124 for the handle 114. The members 122 are pivoted at their apex to one end of a pair of parallel rectangular in transverse section extensions 126 at pivot pin 128. The gripping member 108, which is a steel plate, is welded to the other end of extensions 126, also steel. A stop pin 130 protrudes from guide 116 for retaining the gripping member 108 on the guide 116.

A pair of mirror image mounts 132, 134 are respectively welded to opposite sides of the guide 116 for receiving the support 104 therebetween. Representative mount 132 is an elongated steel element having a step 136 in which the support is nested forming an ear 138. The other mount 134 has an ear 140. The support 104 is pivoted to and between the ears by a pair of spaced pivot pins 142 for rotation about axis 144, a pivot pin being secured to each ear. The cylinder 106 passes between the pivot pins 142 and has a through bore 143 that is uninterrupted for receiving the bolt 6 therein (FIG. 5).

The support 104, FIG. 9, has a lip 146. Each mount 132 and 134 has a lip 148 which selectively engage lip 146. This limits the angular rotation of the assembly 102 support 104 about axis 144 in direction 150. The assembly 102 being rotatable floats relative to the gripping member 108. This floating action permits the angle of the locking mechanism engagement assembly 102 to shift relative to the lock axis 48 and the gripping member 108 during the releasing action of FIG. 5 as explained below. A compression spring 152 is between the mounts 132 and 134 and the gripping member 108 and surrounds the guide 116. Spring 152 urges the members 102 and 108 apart in the quiescent state as shown in phantom in FIG. 9.

In operation of the tool 100 to release the bolt 6 from locked engagement with the lock 4, FIG. 5, the bolt 6 tip 8 end is inserted into the bore of cylinder 106 of assembly 102. The end edge of the cylinder 106 abuts the shoulder 72 of the jaw spreader 56 with the cylinder seated in the bore of the crimp ring 40. The axis of the cylinder 106 is established approximately normal to the plane of the gripping tines 110, it being recalled that the cylinder 106 and assembly 102 is rotatable about axis 144 (FIG. 8).

At the same time that the bolt is being inserted, the tapered proximal end 28 of the lock body 24 is placed between the tines 110. The lock body 24 has a gradually tapering peripheral surface 154 which engages the tines 110. The surface 154 gradually increases to a diameter greater than the spacing between the tines 110, FIG. 5, in the direction 70' toward the lock body 24 distal end 36. The tines 110 engage and thus lock the lock body in the direction 70, FIG. 5. The lock 4 is clamped between the gripping tines 110 and the locking assembly 102 in the axial direction of axes 12, 48.

The handles 112 and 114, FIG. 9, are then manually squeezed together from the phantom position of handle 114 to the solid line position. This action displaces the guide 116 and assembly 102 in direction 70 relative to the gripping tines 110, compressing spring 152. As the guide 116 displaces, it displaces both axially in direction 70 and also rotates relative to the extensions 126 and gripping member 108. This rotation tilts the assembly 102 relative to the guide 116 and gripping member 108 angle α. The member 108 has an opening 156 for receiving the guide 116 and permitting the guide to tilt therein as the guide displaces in directions 158.

The tilting action permits the cylinder 106 longitudinal axis 154 to remain aligned axially with the axes 12, 48 of the engaged locked bolt 6 and lock 4. This tilting precludes binding of the locking assembly 102 that might otherwise occur if the assembly 102 did not tilt during axial displacement toward the gripping member 108. Such binding would interfere with releasing the bolt 6.

As described above, the axial displacement of the assembly 102 relative to the jaws 110, FIG. 5, displaces the spreader in direction 70 spreading the locking jaw assembly 74 radially apart. The jaws are permitted to spread as the spreader at the same time axially displaces the jaw locking member 88 to radially free the locking jaws as shown in FIG. 5. The bolt is easily manually removed from the lock 4 with the jaw assembly 74 so displaced.

The tool 100 because of the mechanical advantage of the linkages formed by guide 116, handle 114, extensions 126 and gripping member 108, provides relatively high leverage for manually compressing the locking spring 98 in the lock 4. The spring 98 relatively high spring constant, requiring a preferred three hundred pound force to compress, is easily overcome by the mechanical advantage of the tool 100. Yet this high force is relatively difficult to overcome by picking, hammer blows or other attempts at tampering without a tool 100.

Only authorized users are provided a tool 100 which is universal for all of the locks 4. This provides a further advantage of not requiring a special different key for each lock. Also, a reusable bolt and lock assembly is provided for the cargo transportation industry.

It will occur to one of ordinary skill that various modifications may be made to the disclosed embodiment, given by way of illustration and not limitation, without departing from the spirit and scope of the invention in the appended claims.

What is claimed is:

1. A tamper resistant lock for locking a bolt having a shank with at least one locking recess, said lock comprising:

a body having a cavity with an opening defining a bolt receiving axis for axially receiving the bolt and said at least one recess within said cavity;

at least one resiliently movable jaw in said cavity resiliently biased radially inwardly by a first bias means; and displaceable jaw locking means including a jaw locking and release member secured in said body cavity for 1a) permitting said at least one movable jaw to transversely displace radially outwardly relative to said axis in response to and for permitting bolt insertion into said cavity in a bolt insertion direction, b) providing radially inward locking engagement of the at least one movable jaw with said bolt recess upon transverse alignment thereof during said insertion and c) precluding the at least one movable jaw from outwardly disengaging the recess in response to bolt withdrawal opposite the bolt insertion direction in a locking state and 2) permitting disengagement of the at least one movable jaw from the recess in response to selective axial displacement of the locking means release member in a first direction to a release state;

said displaceable jaw locking means including second bias means for normally biasing the locking member in said locking state at a substantially greater bias load than that of said first bias means so as to require a separate tool to overcome the bias of said second bias means.

2. The lock of claim 1 wherein the first direction is opposite the insertion direction, the second bias means for biasing the locking means in the insertion direction to said locking state.

3. The lock of claim 1 wherein the second bias means second value is sufficiently high so as to require leveraged manual displacement of said locking means in said first direction to place the locking means in the release state to preclude manual unlocking said locking means to the release state without a tool.

4. The lock of claim 1 wherein the second bias means second value is approximately several hundred pounds.

5. The lock of claim 1 wherein said at least one jaw comprises an annular array of jaws having an annular groove, bias means in said groove for resiliently biasing the jaws radially inwardly in locking engagement with said recess, said locking means comprising:

a. jaw spreading means for radially outwardly displacing the jaws radially apart to disengage the jaws from said recess in response to axial displacement of the spreading means in said first direction; and b. said jaw locking member normally positioned to preclude said radial outward displacing of said jaws, said locking member for engagement with and responsive to said spreader means axial displacement for selectively displacement to permit the radial outward disengagement of said jaws.

6. The lock of claim 5 wherein said jaws define approximately conical jaw segments with inner and outer radially facing approximate conical surfaces, the inner surfaces for engaging said jaw spreader means and said outer surfaces for engaging said jaw locking member.

7. The lock of claim 6 wherein the jaw locking member comprises a cylindrical member axially slidably secured within said cavity of said body and including an inwardly depending conical portion for engaging said outer facing jaw conical surface such that the jaws axially and outwardly displace in a conical path intermediate said spreader means and said jaw locking member during and in response to said bolt insertion.

8. The lock of claim 7 including a cylindrical support in said cavity axially distal said jaw spreading means, and said second bias means including a spring on said support axially abutting said jaw locking member and body, said spring normally resiliently biasing said jaw locking member in the insertion direction to a locking position in said locking state.

9. A tamper resistant lock device comprising:

a bolt with at least one annular groove; and a lock for securing the bolt thereto, said lock comprising:

a body having a cavity with an opening defining a bolt receiving axis for receiving the bolt and said groove within said cavity;

an annular array of movable jaws secured to the body in said cavity including first resilient bias means for normally radially inwardly resiliently biasing the jaws in radial biased locking engagement with said bolt groove in a bolt withdrawal direction; and displaceable jaw release means including a locking member in said body cavity for permitting the jaws to normally spread apart in response to insertion of the bolt into said cavity and for radially locking the jaws to the groove in a locking position to preclude withdrawal of the bolt from the cavity in the withdrawal direction, said release means including means arranged so that said locking member can be selectively axially displaced from the locking position to a jaw release position for permitting the radial spreading of the jaws apart in opposition to said first bias means to release the jaws from said locking engagement and for permitting the bolt to be withdrawn from the cavity in a first direction opposite the insertion direction.

10. The locking device of claim 9 wherein said release means includes second bias means for normally biasing the locking member in said locking position at a substantially greater bias load than that of said first bias means.

11. The locking device of claim 10 wherein the body has proximal and distal ends, the proximal end for receiving the bolt, said jaws defining tapered surfaces tapering to a wider transverse dimension toward said distal end, said jaw release means comprising a jaw spreading member having a tapered surface mating with said jaws for spreading the jaws apart in response to axial displacement of the spreading member in said first direction.

12. The locking device of claim 11 wherein the locking member is a cylindrical member having a tapered surface portion normally radially aligned with said jaws in the locking position, said spreading member and said locking member for engagement at said distal end such that displacement of the spreading member in the first direction displaces the locking member to the release position.

13. The locking device of claim 9 wherein said jaws are approximate segments of a cone and normally in the path of the bolt during insertion into said cavity, said release means defining an approximate conical path for radially outwardly receiving the jaws in response to the bolt insertion into said cavity to thereby permit the displacement of the jaws out of said bolt insertion path in response to said bolt insertion.

14. The locking device of claim 9 wherein the jaws define approximate conical segments having approximate conical inner and outer surfaces, said locking member comprising a member with an internal conical surface facing an outer surface of the jaws, said release means including a jaw spreading member having an external conical surface facing the inner surface of said jaws and an outwardly extending flange distal the jaws, said spreading member including an internal region for axially receiving a spreading member displacement tool in said cavity at the body distal end, and second-bias means for normally biasing the locking member in abutment with the flange, said spreading member and locking member defining an approximate conical path therebetween for receiving said jaws in response to said bolt insertion, whereby displacement of the spreading member in the first direction spreads the jaws apart while simultaneously displaces the locking member to release said jaws during said spreading.

15. A lock for locking a bolt having an annular groove comprising:

a body with an axially extending through bore having a locking cavity in communication therewith, said bore for receiving the bolt at a bore proximal end;

a substantially tubular support member in said cavity at said proximal end thereof having a bore for receiving the bolt therethrough;

resilient first bias means supported by the support member;

a locking member in the cavity having a tapered radially inwardly extending bore portion abutting said first bias means for selective displacement toward the proximal end;

a jaw spreading member having an opening for receiving the bolt therethrough, said spreading member having an outer tapered surface transversely widening toward the body distal end, and including a flange adjacent to said widened tapered surface at said distal end, said flange abutting the locking member; and an annular array of radially inwardly biased jaws aligned intermediate said spreading member and said locking member, each jaw including a projection normally biased in engagement with said bolt groove in a locking position, insertion of the bolt displacing the jaws out of the path of said bolt while the locking member is positioned to lock the jaws in a withdrawal direction and selective displacement of the spreading member for simultaneously displacing the locking member and the jaws to disengage the projections from the bolt groove.

16. A tamper resistant lock for locking a bolt having a shank with at least one locking recess, said lock comprising:

a body having a cavity with an opening defining a bolt receiving axis for axially receiving the bolt and said at least one recess within said cavity;

at least one radially inwardly movable jaw in said cavity resiliently biased by a first bias means; and displaceable jaw locking means including a movable locking member having selected jaw locking and release positions secured in said body cavity for 1 a) permitting said at least one movable jaw to transversely displace outwardly relative to said axis in response to and for permitting bolt insertion into said cavity in a bolt insertion direction, b) providing radially inward locking engagement of the at least one movable jaw with said bolt recess upon transverse alignment thereof and c) precluding the at least one movable jaw from outwardly disengaging the recess in response to bolt withdrawal opposite the bolt insertion direction in a locking state and 2) for permitting disengagement of the at least one movable jaw from the recess in response to selective axial displacement of the locking means locking member in a first direction to a release state;

said locking means including second bias means for normally biasing the locking member in the locking state at a substantially greater bias load than that of said first bias means.

17. A lock for locking a bolt having a shank with at least one locking recess, said lock comprising:

a body having a cavity with an opening defining a bolt receiving axis for axially receiving the bolt and said at least one recess within said cavity;

at least one resiliently biased movable jaw in said cavity; and displaceable jaw locking means including a movable locking member having selected jaw locking and release positions secured in said body cavity for 1 a) permitting said at least one movable jaw to transversely displace outwardly relative to said axis in response to and for permitting bolt insertion into said cavity in a bolt insertion direction, b) providing radially inward locking engagement of the at least one movable jaw with said bolt recess upon transverse alignment thereof and c) precluding the at least one movable jaw from outwardly disengaging the recess in response to bolt withdrawal opposite the bolt insertion direction in a locking state and 2) for permitting disengagement of the at least one movable jaw from the recess in response to selective axial displacement of the locking means locking member in a first direction to a release state;

said at least one jaw comprising an annular array of jaws having an annular groove, bias means in said groove for resiliently biasing the jaws radially inwardly in locking engagement with said recess, said locking means comprising:

a. jaw spreading means for radially outwardly displacing the jaws radially apart to disengage the jaws from said recess in response to axial displacement of the spreading means in said first direction; and b. said movable locking member normally positioned to preclude said radial outward displacing of said jaws, said locking member for engagement with and responsive to said spreader means axial displacement for selectively displacement to permit the radial outward disengagement of said jaws.

18. A locking device comprising:

a bolt with at least one annular groove; and a lock for securing the bolt thereto, said lock comprising:

a body having a cavity with an opening defining a bolt receiving axis for receiving the bolt and said groove within said cavity;

an annular array of movable jaws secured to the body in said cavity including first bias means for normally biased locking engagement with said bolt groove in a bolt withdrawal direction; and displaceable jaw release means including a locking member in said body cavity for permitting the jaws to normally spread apart only in response to insertion of the bolt into said cavity and for radially locking the jaws to the groove in a locking position to preclude withdrawal of the bolt from the cavity in the withdrawal direction, said release means including means arranged so that said locking member can be selectively axially displaced from the locking position to a jaw release position for permitting the bolt to be withdrawn from the cavity in a first direction opposite the insertion direction;

said release means including second bias means for normally biasing the locking member in said locking position at a substantially greater bias load than that of said first bias means.

19. A locking device comprising:

a bolt with at least one annular groove; and a lock for securing the bolt thereto, said lock comprising:

a body having a cavity with an opening defining a bolt receiving axis for receiving the bolt and said groove within said cavity;

an annular array of movable jaws secured to the body in said cavity including first bias means for normally biased locking engagement with said bolt groove in a bolt withdrawal direction; and displaceable jaw release means including a locking member in said body cavity for permitting the jaws to normally spread apart only in response to insertion of the bolt into said cavity and for radially locking the jaws to the groove in a locking position to preclude withdrawal of the bolt from the cavity in the withdrawal direction, said release means including means arranged so that said locking member can be selectively axially displaced from the locking position to a jaw release position for permitting the bolt to be withdrawn from the cavity in a first direction opposite the insertion direction;

said jaws being approximate segments of a cone and normally in the path of the bolt during insertion into said cavity, said release means defining an approximate conical path for radially outwardly receiving the jaws in response to the bolt insertion into said cavity to thereby permit displacement of the jaws out of said bolt insertion path.

20. A locking device comprising:

a bolt with at least one annular groove; and a lock for securing the bolt thereto, said lock comprising:

a body having a cavity with an opening defining a bolt receiving axis for receiving the bolt and said groove within said cavity;

an annular array of movable jaws secured to the body in said cavity including first bias means for normally biased locking engagement with said bolt groove in a bolt withdrawal direction; and displaceable jaw release means including a locking member in said body cavity for permitting the jaws to normally spread apart only in response to insertion of the bolt into said cavity and for radially locking the jaws to the groove in a locking position to preclude withdrawal of the bolt from the cavity in the withdrawal direction, said release means including means arranged so that said locking member can be selectively axially displaced from the locking position to a jaw release position for permitting the bolt to be withdrawn from the cavity in a first direction opposite the insertion direction;

the jaws defining approximate conical segments having approximate conical inner and outer surfaces, said locking member comprising a member with an internal conical surface facing an outer surface of the jaws, said release means including a jaw spreading member having an external conical surface facing the inner surface of said jaws and an outwardly extending flange distal the jaws, said spreading member including an internal region for axially receiving a spreading member displacement tool in said cavity at the body distal end, and second bias means for normally biasing the locking member in abutment with the flange, said spreading member and locking member defining an approximate conical path therebetween for receiving said jaws in response to said bolt insertion, whereby displacement of the spreading member in the first direction spreads the jaws apart while simultaneously displaces the locking member to release said jaws during said spreading.

* * * * *